United States Patent [19]

Knickerbocker

[11] Patent Number: 4,626,057

[45] Date of Patent: Dec. 2, 1986

[54] EIGHT CONDUCTOR MODULAR PLUG

[75] Inventor: Robert H. Knickerbocker, Cheshire, Conn.

[73] Assignee: The Siemon Company, Watertown, Conn.

[21] Appl. No.: 789,478

[22] Filed: Oct. 21, 1985

[51] Int. Cl.[4] ..... H01R 13/627

[52] U.S. Cl. ..... 339/91 R; 339/176 M

[58] Field of Search ..... 339/176 M, 91 R, 186 R, 339/186 M, 154 A, 155 R, 156 R, 166 R

[56] References Cited

U.S. PATENT DOCUMENTS

| | | | |
|---|---|---|---|
| 3,860,316 | 1/1975 | Hardesty | 339/91 R |
| 4,040,699 | 8/1977 | Rasmussen | 339/91 R |
| 4,224,485 | 9/1980 | Krumreich | 339/176 M |
| 4,241,974 | 12/1980 | Hardesty | 339/176 M |
| 4,373,766 | 2/1983 | Johnston | 339/176 M |

FOREIGN PATENT DOCUMENTS

| | | | |
|---|---|---|---|
| 365703 | 9/1921 | Fed. Rep. of Germany | 339/186 M |
| 2532885 | 12/1976 | Fed. Rep. of Germany | 339/186 R |
| 555601 | 7/1923 | France | 339/154 A |

*Primary Examiner*—John McQuade

*Attorney, Agent, or Firm*—Fishman & Dionne

[57] ABSTRACT

A "universal" eight wire modular plug capable of insertion into any 6 or 8 wire modular jack is presented. The modular plug comprises eight conductive contacts, each conductive contact respectively attached to a wire leading therefrom, all of which are encased in an insulating housing. The eight wire modular plug housing has a streamlined configuration which permits entry thereof into any 6 or 8 wire modular jack. A pair of ramps are also provided to the modular plug to insure snap-fitting into certain 6 wire jacks having interior obstructions.

3 Claims, 5 Drawing Figures

EIGHT CONDUCTOR MODULAR PLUG

BACKGROUND OF THE INVENTION

This invention relates to a modular plug for use in the telephonic and related industries. More particularly, this invention relates to a new and improved eight wire modular plug which can be used interchangeably on any 6 or 8 wire modular jack. The eight wire modular plug of the present invention thus provides access to a standard, conventional 6 or 8 wire modular jack for hooking up a variety of well known telephone and similar equipment.

In the telephonic and related arts, modular jacks and corresponding modular plugs are well known and have been increasingly utilized for effecting communication between telephonic and other equipment. It is also well known that modular plugs for eight wire jacks differ in size from modular plugs for six wire modular jacks. Modular plugs for eight wire jacks are larger than six wire modular plugs and therefore, eight wire modular plugs cannot be used in conjunction with six wire modular jack (it will be appreciated that six or eight wire modular jacks may have one or two pairs, i.e., be 2 or 4 wire). Restated, a modular jack of standard construction for a six wire modular plug has a first sized opening for receiving a modular plug which is smaller than the corresponding second sized opening in an eight wire modular for receiving an eight wire modular plug. As a result, different prior art modular plugs (i.e., a smaller modular plug for the smaller sized opening in a 6 wire modular jack and a larger modular plug for the larger sized opening in an 8 wire modular jack) have had to be used depending upon the modular jack which is to be interfaced (i.e., six wire plug, eight wire plug, etc.). This has created extra purchasing and manufacturing costs as well as complicating repair and installation activity.

In an effort to overcome this problem, U.S. patent application Ser. No. 634,818, assigned to the assignee hereof and incorporated herein by reference, discloses a "universal" eight wire modular plug which is capable of interfacing or plugging into any six or eight wire modular jack. As mentioned, a 6 or 8 wire modular jack may have 1 or 2 pairs, i.e., be 2 or 4 wires. The eight wire modular plug disclosed in U.S. Ser. No. 634,818 (which can fit into any six or eight wire modular jack) is suitable for use on a variety of telephonic and related equipment including, for example, a modular plug ended test adapter such as disclosed in U.S. patent application Ser. No. 634,818, which is also assigned to the assignee hereof and incorporated herein by reference. The modular plug of U.S. Ser. No. 634,818, therefore, provides increased versatility and capabilities relative to prior art modular plugs and permits the use of only one modular plug for both six or eight wire jacks. Also, great cost savings and ease of use are achieved thereby.

The modular plug of U.S. Ser. No. 634,818 comprises eight conductive contacts, each contact respectively attached to a wire or lead. The contacts and attached wires are all encased in an insulating housing having a well known snap lock lever thereon for locking into a conventional six or eight wire modular jack. Significantly, the eight wire modular plug housing of U.S. Ser. No. 634,818 has a relatively narrower configuration at one end thereof (provided by stepped-in side portions) which permits entry or insertion into any six or eight wire modular jack regardless of the size of the receiving opening in the particular modular jack.

While well suited for its intended purposes, it has been found that certain 6 position modular jacks are manufactured with a small molded shoulder or extension located internally of the jack. This shoulder will act to obstruct or stop the "universal" eight position modular plug of U.S. Ser. No. 634,818 from forming a secure snap fit within such a modular jack.

SUMMARY OF THE INVENTION

The above discussed and other problems of the prior art are overcome or alleviated by the improved "universal" modular plug of the present invention. In accordance with the present invention, a "universal" eight wire modular plug of the type disclosed in U.S. Ser. No. 634,818 is provided with a pair of beveled edges, i.e., ramped surfaces on opposite sides of the snap lock lever. These ramps are preferably 45 degrees and are positioned so as to bypass any obstructions (i.e., shoulders, extensions, etc.) which are commonly present in certain conventional 6 position modular jacks. As a result, the "universal" modular plug having novel ramps in accordance with the present invention will insure a strong and secure snap-fit within any modular jack.

The above discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
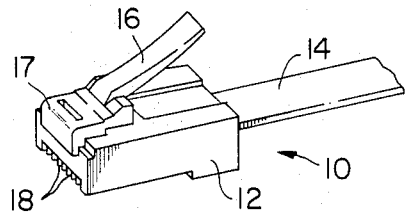
FIG. 1 PRIOR ART
FIG. 1 is a perspective view of an eight wire modular plug in accordance with the prior art.

Referring first to FIG. 1, an eight wire modular plug in accordance with the prior art is shown generally at 10. Modular plug 10 is comprised of a housing 12 connected to a lead 14. Nose portion 17 of plug 10 has attached thereto a conventional snap lock lever 16 which provides firm locking engagement to a suitable eight wire modular jack (not shown). Eight (8) contacts 18 are provided at the leading edge of housing 12 and connect to corresponding contacts in an eight wire jack. Each contact 18 is respectively connected to one of eight wires (not shown) which are provided within the housing 12 and are encased in the insulating lead 14.

While suitable for its intended applications, the known eight wire plug 12 of FIG. 1 suffers from certain above described drawbacks including the fact that it can only cooperate with and be engaged to an eight wire modular jack. This obviously diminishes the utility and versatility of the prior art plug 10.

In an attempt to overcome the problems of the prior art, U.S. Ser. No. 634,818 describes the "universal" eight wire modular plug shown generally at 20 in FIG.

2. Like prior art modular plug 10, "universal" modular plug 20 is comprised of a housing 22 and is connected to an insulating lead 24. However, unlike plug 10, housing 22 of the "universal" eight wire modular jack 20 has been modified so that it is capable of fitting into any six or eight wire modular jack. As mentioned, it will be understood that a six or eight wire modular jack may have 1 or 2 pairs, i.e., be 2 or 4 wires. This novel and distinguishing feature is effected by providing stepped in side portions 26 to nose portion 27 of housing 22. Accordingly, nose portion 27 will be the same width for any 6 or 8 wire modular jack. It is important that stepped in side portions 26 be the same size on either side of housing 12 so as to permit proper mechanical and electrical connection between a modular jack and the modular plug of FIG. 2. Thus, unlike a conventional eight wire modular plug 12, which has a wider nose portion relative to six wire plugs, the eight wire plug 20 of the U.S. Ser. No. 634,818 has universal sizing for any six or eight wire applications.

Figure 2:
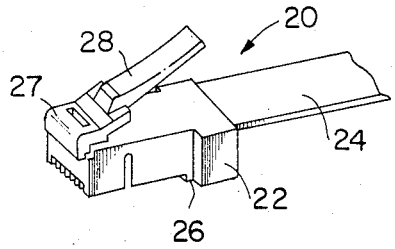
FIG. 2 PRIOR ART
FIG. 2 is a perspective view of a "universal" eight wire modular plug in accordance with U.S. Ser. No. 634,818.

Other portions of eight wire plug 20 of FIG. 2 are very similar to, if not identical with, the prior art plug 10 of FIG. 1. Thus, modular plug 20 is provided with a conventional snap lock lever 28 for locking engagement to either a six or eight wire modular jack (not shown).

While suitable for its intended purposes, as mentioned, the universal modular plug of U.S. Ser. No. 634,818 (FIG. 2) is incapable of effecting a secure snap-fit with certain six position modular jacks due to the presence of obstructions within the modular jack interior.

Figure 3:
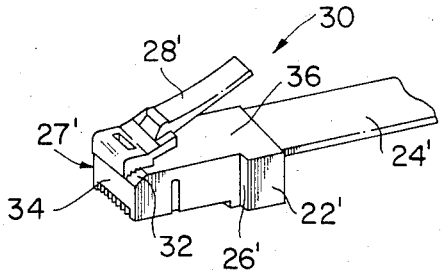
FIG. 3 is a perspective view of an eight wire modular plug in accordance with the present invention.
Figure 4:
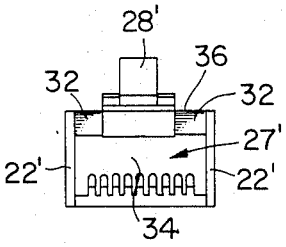
FIG. 4 is an enlarged front elevation view of the modular plug of FIG. 3.
Figure 5:
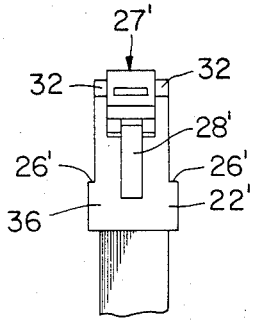
FIG. 5 is a top view of the modular plug of FIG. 3.

Turning now to FIGS. 3–5, in accordance with the present invention, the deficiencies of the FIG. 2 "universal" eight wire modular plug are overcome by providing a pair of beveled edges on opposed sides of the snap-lock lever to preclude any contact with obstructions within the modular jack. In FIGS. 3–5, the modular plug of the present invention is generally shown at 30. Modular plug 30 is substantially similar to modular plug 20 of FIG. 2 except for the addition of beveled edges 32. Accordingly, where appropriate, the same reference numerals have been used with the addition of a prime.

Beveled edges 30 in FIGS. 3–5 are positioned on either side of snap-lock lever 28' at the interface between the planar front face 34 of modular plug 30 and the top planar surface 36 thereof. Preferably, beveled edges 32 are in the form of ramps and are at a 45 degree angle relative to both front face 34 and top surface 36. It will be appreciated that housing 22' of plug 30 is preferably comprised of an insulative plastic material with beveled edges 32 being either molded directly therein; or provided subsequent to molding by removal of selected portions of the housing.

The internal wiring and molded structure of modular plug 30 is also substantially similar to both prior art FIGS. 1 and 2. Accordingly, attention is directed to U.S. Ser. No. 634,818 for structural and electrical details of the modular plug interior.

It will be appreciated that a preferred invention discloses a "ramped" configuration for avoiding the obstructions located in certain six position modular jacks. It is contemplated however, that other bevel shaped surfaces (other than ramps) on either side of snap-lock lever 28' could also be used so long as sufficient housing material is removed to avoid the obstructions in certain six position modular jack interiors.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. In an eight wire modular plug for telephonic and related equipment including an insulating housing having eight contacts, each contact connected to a wire lead, the housing having apertures to permit access between the eight contacts and a modular jack, and the housing having a locking means thereon, the improvements comprising:

a pair of oppositely disposed stepped-in portions along the sides of said housing wherein at least a portion of said housing is capable of insertion into either a six or eight position modular jack of standard construction, wherein the six position modular jack of standard construction has a first sized opening for receiving said modular plug housing, and wherein the eight wire modular jack of standard construction has a second sized opening for receiving said modular plug housing, said second opening being larger than said first opening; and a pair of beveled edges, each of said beveled edges being oppositely disposed on either side of said locking means to allow the plug to bypass interior obstructions commonly found in six position jacks.

2. The modular plug of claim 1 wherein:

said beveled edges are ramp means.

3. The modular plug of claim 2 wherein:

said ramp means have a 45 degree angle.

* * * * *